United States Patent [19]

Rodriguez

[11] 4,088,251

[45] May 9, 1978

[54] TENNIS BALL DEVICE

[76] Inventor: Ernesto Rodriguez, 304 Eden Dr., Longview, Tex. 75601

[21] Appl. No.: 745,479

[22] Filed: Nov. 26, 1976

[51] Int. Cl.[2] ..... A45C 11/00

[52] U.S. Cl. ..... 224/5 D; 206/315 B; 221/303; 221/309; 224/45 L; 273/73 R; 294/19 A

[58] Field of Search ..... 224/5 R, 5 C, 5 D, 5 Q, 224/5.1, 26 R, 45 L, 5 A, 5 BC, 15, 17, 25 A, 26 B; 206/315 B; 211/14, 15; 294/19 A; 221/303, 307, 309, 185, 187, 188, 191; 273/73 R; 150/1.5 R, 1.5 C, 52 A, 52 G; 274/74

[56] References Cited

U.S. PATENT DOCUMENTS

| | | | |
|---|---|---|---|
| 1,754,495 | 4/1930 | Anderson | 224/5 D X |
| 2,524,639 | 10/1950 | Saunders | 224/26 R |
| 2,756,914 | 7/1956 | Bonderer | 224/5 D X |
| 2,760,807 | 8/1956 | Watson | 294/19 A |
| 3,889,950 | 6/1975 | Kasravi | 206/315 B |
| 4,002,337 | 1/1977 | Rayfield | 206/315 B |

FOREIGN PATENT DOCUMENTS

| | | | |
|---|---|---|---|
| 446,938 | 3/1948 | Canada | 211/14 |
| 1,429,211 | 4/1965 | France | 294/19 A |
| 1,236,144 | 12/1962 | Germany | 224/5.1 |
| 670,984 | 4/1952 | United Kingdom | 211/14 |

*Primary Examiner*—Trygve M. Blix
*Assistant Examiner*—Winston H. Douglas
*Attorney, Agent, or Firm*—Clarence A. O'Brien; Harvey B. Jacobson

[57] ABSTRACT

A tennis ball device for use by tennis players and the like which mounts upon the back of a tennis player by means of an adjustable shoulder strap together with an adjustable waist belt and is provided with a dispenser end extending at substantially right angles from the bottom of the device. The device also is provided with resilient strap structure for holding the player's tennis racket. An elliptical outlet opening on the dispenser portion together with a thumb recess enables the player to quickly and easily obtain a tennis ball from the device when needed. The dispenser end is inclined upwardly from the right angle position of the end so that the stored tennis balls normally will not be at the open end of the dispenser unit until such time as the user of the device tilts the device backwardly. Other features include a flanged lip member at the upper end of the holder for positive retention of the tennis balls within the holder, together with an additional feature of being able to be used as a tennis ball pick up device. Another embodiment provides for perforated apertures in the holder for increased lightness of the device as well as visibility of the number of tennis balls contained therewithin.

9 Claims, 8 Drawing Figures

TENNIS BALL DEVICE

BACKGROUND OF THE INVENTION

1. Field of the Invention

This invention relates generally to devices for use by tennis players to increase the benefits of playing the game of tennis as well as decrease the necessary chores thereof.

2. Description of the Prior Art

A common problem wth known type devices for dispensing balls is that they normally are not arranged for easy mounting and supporting upon the back of the user of the device. They also normally do not provide foolproof dispensing means as associated with the device to insure that only one ball at a time as desired will be dispensed.

Another problem with known type devices is that they are not provided with easily adjustable and attachable shoulder and waist strap devices.

Another problem with known type devices is that they are not designed specifically for use by tennis players and do not have a number of desirable features for such players such as ball pickup, racket attachment means, etc.

Known prior art patents which may be pertinent to this invention are as follows:

| | | |
|---|---|---|
| 1,754,495 | 0. A. Anderson | April 15, 1930 |
| 1,778,225 | B. B. Morss | Oct. 14, 1930 |
| 1,940,321 | W. P. Pagett | Dec. 19, 1933 |
| 2,516,997 | J. Kellinger et al | Aug. 1, 1950 |
| 2,768,775 | R. C. Houser | Oct. 30, 1956 |

None of these known prior art devices offers the new and unique features of the invention disclosed herein.

SUMMARY OF THE INVENTION

An object of the present invention is to provide a tennis ball device for holding and dispensing a tennis ball as needed by a tennis player.

Another object of the present invention is to provide a tennis ball holder which is easily and quickly mountable and attachable on the back of a tennis player. Adjustable shoulder strap structure together with an adjustable waist strap structure are provided with the device for effecting this purpose.

A further object of this invention is to provide a tennis ball holder device which will positively retain stored tennis balls therewithin until such time as a player wishes a ball, and then will permit the player to easily remove a single ball therefrom without danger of any additional balls being dispensed. A unique, tilted-up projecting end dispenser structure together with a elliptical opening and thumb recess associated therewith is provided to effect this object.

A still further object of this invention is to provide a tennis ball device having resilient strap structure associated therewith for holding and supporting the player's tennis racket from the device.

Another still further object of this invention is to provide lightening holes in the body of the device for the purpose of decreasing the overall weight thereof together with the additional desirable benefit of permitting a quick visual check of the number of tennis balls remaining stored therewithin.

The tennis ball device of this invention has a number of new and unique features. It enables a tennis player to store a plurality of tennis balls, normally up to twelve therewithin, and also enables said player to dispense a single ball, one at a time, quickly and easily as needed. It has means for positively retaining the remaining stored balls therewithin without any danger of more than a single ball being dispensed at a time.

Additional important features are in the adjustable shoulder strap together with the adjustable waistband strap for permitting a player to satisfactorily mount and support the device from and upon his back. Also, it permits the adjustments to be made initially and then a quick attach-detach fastener will permit the device to be quickly attached and detached without repeated adjustments of the straps thereafter.

Another important feature is the projecting dispenser end at the lower portion of the holder which projects at substantially right angles from the holder with a slight upward tilt or angle thereto. This upward angle, of at least 10°, normally causes the stored balls to remain within the vertical portion of the holder and decreases the danger of any ball being inadvertently shaken or discharged from the dispenser end. Only when the tennis player tilts the holder in a backward or sidewise direction from the vertical plane of his back, will the lowermost ball roll forwardly to the open end of the dispenser projection. Also, the elliptical shape of the open dispenser end, which is of less overall size than the tennis ball which is of official size, will prevent an undesired roll out of the ball. A recessed opening extending from the top open edge of the elliptical opening provides an open portion wherein the player's thumb may grasp the upper portion of the ball behind the center line thereof to forcibly roll and remove the ball through the elliptical dispenser opening. All of these features, i.e., the upward tilt of approximately 10° of the dispenser end, the elliptical opening of less size than the tennis ball across the narrow dimension of said opening, together with the recessed thumb aperture all prevent inadvertent discharge of a tennis ball other than when the tennis player desires same.

Another important feature is in the resilient straps associated with the device for releasably retaining a tennis racket supported from the device. This enables a tennis player to walk, run, ride a bicycle or use other means of transportation with the device secured upon his back and with all the equipment necessary for playing tennis, i.e., the tennis balls together with the tennis racket all securely mounted upon his back out of the way and yet convenient and ready for immediate use.

Another desirable feature of the tennis ball device is in the upper end of the holder which is provided with a extending outer flange for preventing the resilient straps from slipping off of said end, as well as a resilient inner flange portion which permits the overall device to be used as a tennis ball pick-up structure. When the player removes the overall holder from his back after all the balls have been dispensed therefrom, he may then invert the device and by putting the hole provided at the upper end of the device over a ball in the inverted position, and pressing down upon the holder over the ball the inner resilient flange will deform substantially to allow the ball to pop into the holder. The player thus may pick up a number of balls lying upon the court without stooping or bending as is normally required.

Another feature of the device is that it may be made of any lightweight plastic or other suitable material together with nylon or plastic type straps and resilient top and bottom bands.

A further embodiment consists of providing lightening apertures for the main holder structure to thereby decrease the overall weight of the device substantially. Also in addition to the very desirable benefit of reduced weight, an additional benefit is of being able to quickly visually tell how many tennis balls remain stored within the holder.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
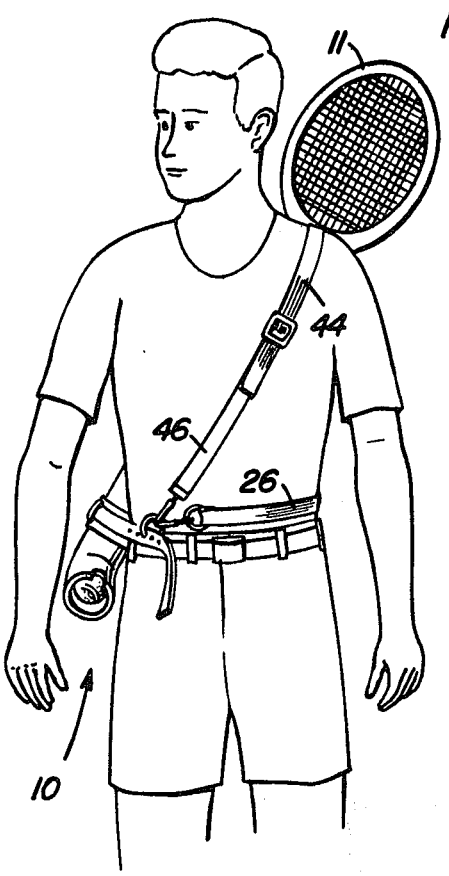
FIG. 1 is a front view of the device as in use by a tennis player.
Figure 2:
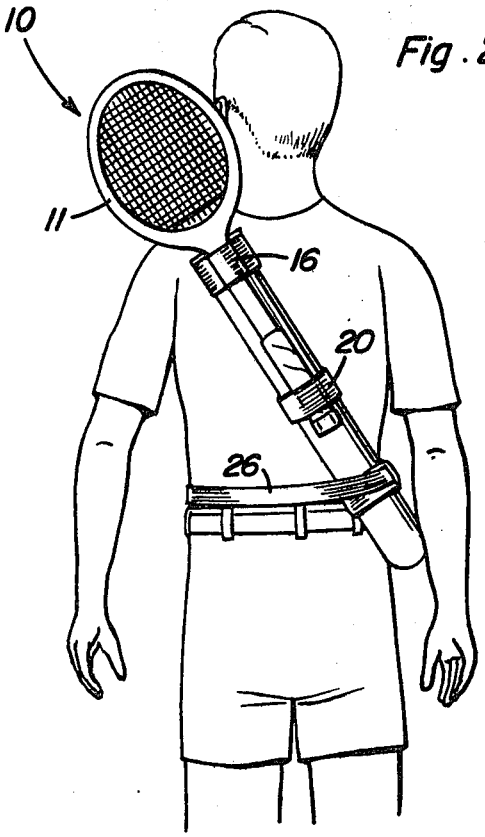
FIG. 2 is a rear view of the device as in use by a tennis player.

Referring to FIGS. 1 and 2 of the drawings, reference numeral 10 indicates in general the tennis ball device of this invention as mounted and supported upon the back of a tennis player. As can be seen from the front view of FIG. 1, a shoulder strap 44, 46 together with a waist strap 26 holds the device upon the back of the player.

As can be seen in FIG. 2, the tennis racket 11 may be also carried from the device by means of the resilient band 16 and resilient band 20. This enables the tennis player to ride a bicyle, walk, run, or otherwise move about with complete freedom with all the necessary paraphernalia supported upon the player's back.

Figure 3:
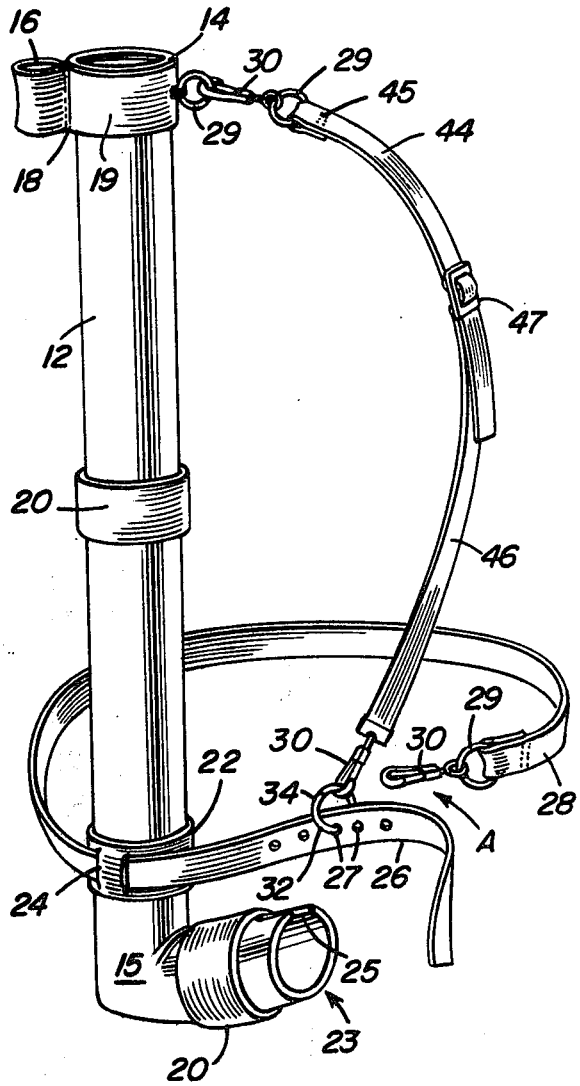
FIG. 3 is a side elevational view of the device per se.

FIG. 3 shows a detailed arrangement of the mounting straps. The main holder 12 for the device consists of a tubular receptacle of slightly larger internal diameter than conventional size tennis balls, which are normally No. 3 balls according to the U.S. Tennis Association rules, and of approximately 2½ inches to 2⅝ inches in diameter and weigh from 2 ounces to 2-1/16 ounces. The balls are dispensed from the lower end of the tubular receptacle 12, which is normally supported in a vertical position, or at least in a vertical plane as mounted upon the back of the player, even though tilted at an angle with respect to the player so that the dispenser end 15 may extend forwardly along one side of the waist of the player. The projecting dispenser end 15 is provided with an elliptical dispenser opening 23 having a thumb recess 25 provided therewithin. Resilient sweat bands 20 are normally provided along the device, and as seen in FIG. 3, one band is mounted on the dispenser projecting end while another band is mounted midway of the tennis ball primary holder 12. Another similar band 19 is provided at the top of the holder together with a resilient end 16 of smaller inner diameter for resiliently retaining the handle of a tennis racket. A stitched portion 18 connects the tennis racket handle retaining portion 16 with the band 19 surrounding the upper end of the holder 12. Attached at the opposite side of the band 19 is a shoulder strap retaining ring 29. A lip extending from the upper end 14 of the holder 12 is provided to prevent the band from slipping upwardly and off the end of the holder.

Another resilient band 22 is provided near the lower end of the holder with slots 24 provided therewithin for reception of the waist strap 26 therethrough. Apertures 27 are provided near one end of the waist strap 26 while the other end of the strap, shown as 28 in FIG. 3, has another ring 29 attached thereto. This ring 29 supports a snap fastener of swivel type 30 for providing a quick attach-detach structure for the waist strap. A ring 32 is normally mounted through one of the apertures 27 provided in the strap for permitting the adjustment of proper waist size. A slotted portion 34 through the ring permits the ring to be slipped through the appropriate hole 27 according to the size of the waist of the player. Another swivel snap 30 is provided and attached to the adjustment ring 32 for attachment of the lower end 46 of the adjustable shoulder strap. The upper end 44 of the adjustable shoulder strap has suitable stitching such as 45 for retention of another ring 29 and another swivel snap 30 for quick attach-detach to the upper ring 29 of the holder. An adjusting buckle 47 is provided for the two shoulder strap portions 44 and 46 to permit proper adjustment of same in a conventional manner.

As one can readily visualize by looking at FIGS. 1 and 3, once the shoulder strap 44, 46 is properly adjusted through the buckle 47 and as attached by the swivel connectors 30 at each end thereof to the upper and lower rings 29 and 32 respectively, with, of course, the ring 32 having been adjusted for proper waist size, the player may then very quickly put his one arm through the space between the receptacle 12 and the straps and quickly mount the device upon his back. Then by merely putting the waist strap 26 around his waist and snapping the strap fastener 30 at the end 28 thereof to the ring 32, the device is properly supported and mounted to his body. Normally by just unsnapping the one snap indicated by reference latter A in FIG. 3, the player may quickly attach and detach the overall structure without any further adjustments thereafter.

Figure 6:
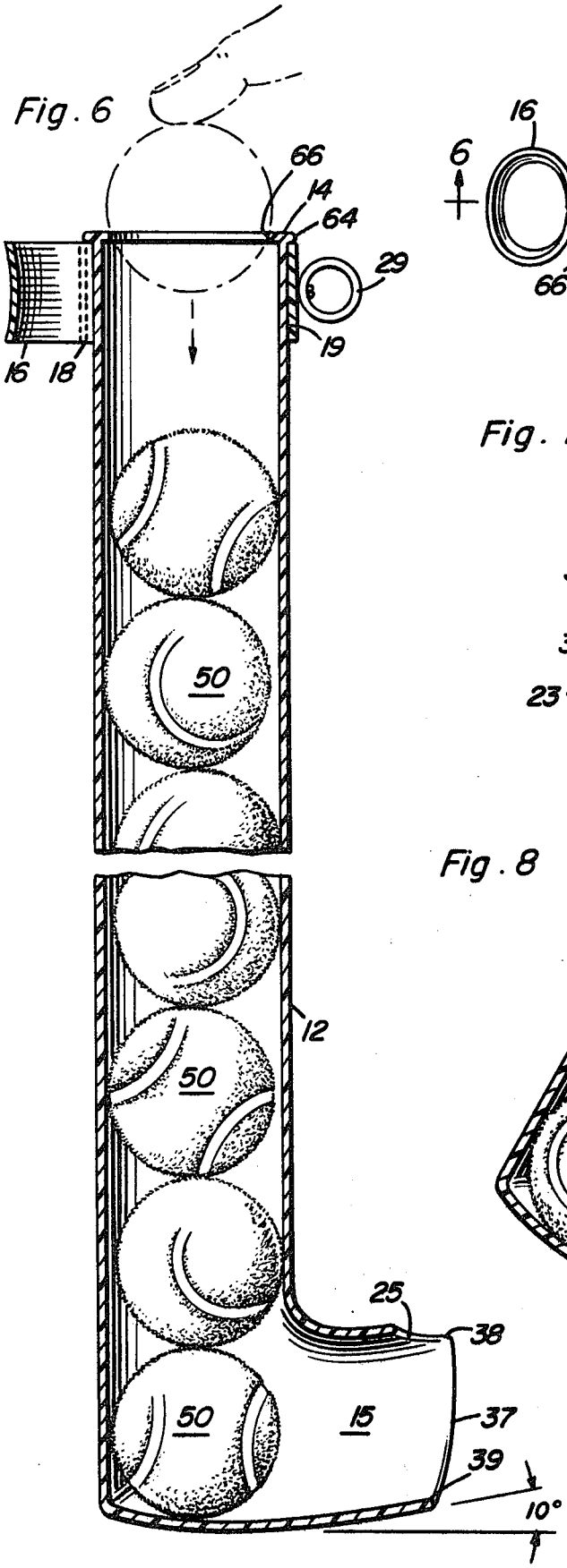
FIG. 6 is a side elevational view, partly in cross section, of the device.
Figure 5:
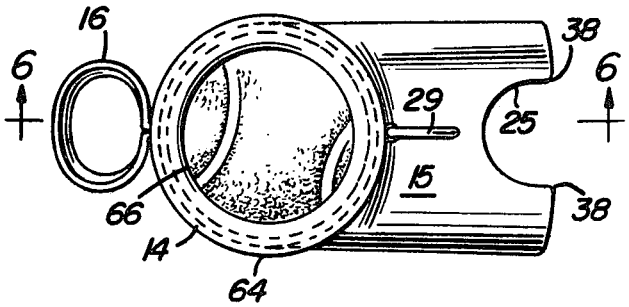
FIG. 5 is a top plan view of the device.
Figure 7:
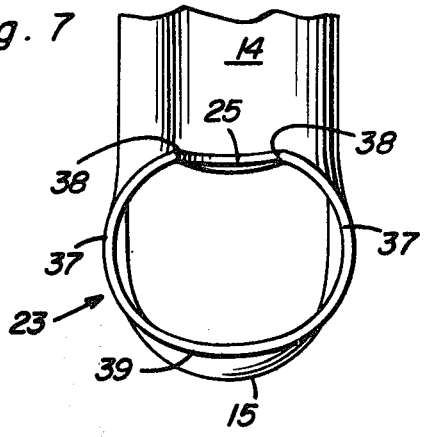
FIG. 7 is a fragmentary front view of the lower portion of the tennis ball dispenser end of the device.
Figure 8:
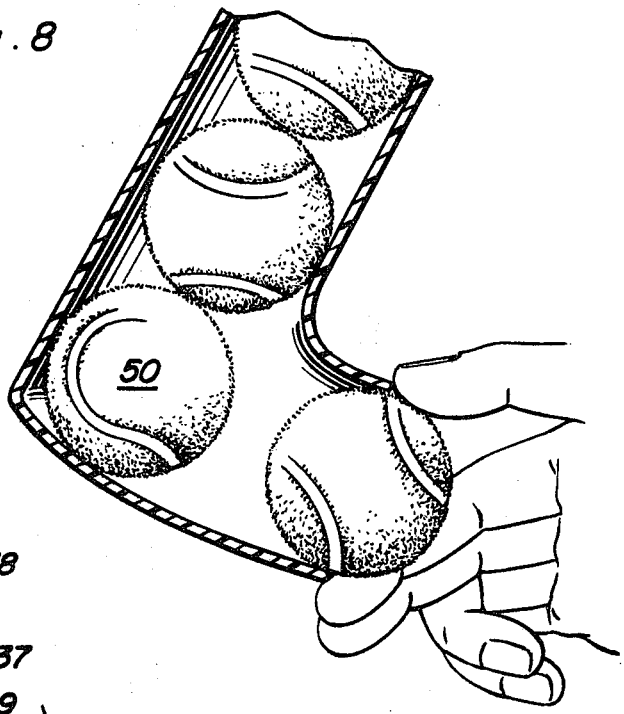
FIG. 8 is a fragmentary side elevational view, partly in cross section, of the dispenser end as in use to dispense a single tennis ball.

Now looking at FIGS. 5–8, the new and unique features of the dispenser unit will be described in detail. As can be seen in FIG. 6, a plurality of tennis balls 50 are supported in the substantially vertical main receptacle 12 with the projecting dispenser portion 15 extending to the right at the bottom thereof. As can be seen in the Figure, the outer right end of the dispenser projection is tilted upwardly at least 10 degrees from the right angle which the projection makes with the vertical body. This is an important feature in that it normally will cause the tennis balls to remain in a vertical position as seen in FIG. 6 and without any tendency for the lowermost ball to be discharged out the opening. As can be seen by looking at the various views, the dispenser opening 23 is substantially elliptical or egg-shaped in configuration. Across the side edges 37 of the opening the distance is substantially greater than across the edge portions 39–38. With a distance between the bottom edge 39 and the top tips 38 being of less distance than the diameter of the tennis ball, i.e., less than 2½ inches, the elliptical opening itself will prevent a ball from accidentally being discharged or dispensed out the end. A thumb recess 25 is provided so that the player may grip the upper portion of the tennis ball, and normally slightly behind the center line through the ball at the point where the opening edges touch same, to enable the player to quickly and easily remove the desired single ball from the holder, as best seen in FIG. 8. Thus, in use the device must nomally be titled backwardly to roll the lowermost ball forwardly to the opening and then the additional step of grasping the ball between the player's forefinger and thumb must take place before the ball is dispensed. This feature is extremely important in that it prevents balls from being discharged before the player is ready for same and until he intentionally assists in the dispensation of same.

Looking at FIG. 6, another important feature of the overall device will be described. While the projecting rim 64 on the top end 14 of the holder 12 prevents the resilient band 19 from slipping off the upper end thereof, an inward projection 66 of smaller diameter than the conventional 2½ inch size of official tennis ball is also provided. This enables the overall holder to be used as a tennis pick-up ball device. That is, once all the stored balls have been used by the player and some of the balls are laying around the court ready to be picked up, the player may quickly remove the device from his back and then by inverting same use the formerly top end of the holder by means of the resilient inwardly projecting flange 66 to pick up the balls. By placing the opening at this end of the holder over the ball on the ground and then pushing downwardly on the overall device, the ball will snap through the reduced opening 66 and into the holder. Thus, the player may pick up a large number of balls ready for the next game.

Figure 4:
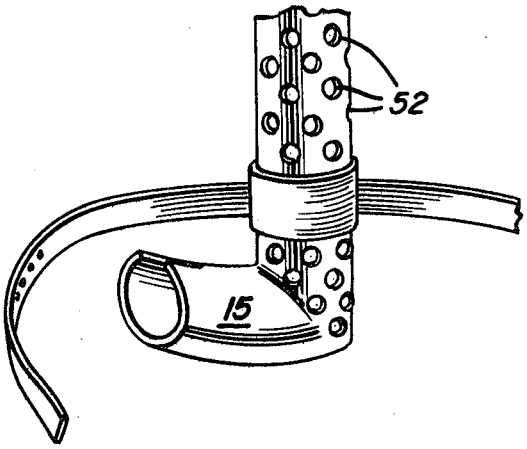
FIG. 4 is a fragmentary side elevational view of a modified embodiment of the device.

FIG. 4 shows another embodiment of the device wherein the body portion 12 is provided with a plurality of apertures 52 therethrough. These apertures 52 are for two desirable functions. They perform a lightening of the overall structure, and also provide a quick visual means of determining the number of tennis balls remaining stored within the holder.

The storing tube 12 may be made of plastic material which is the preferable one, but also may be made of rubber, leather, lightweight wood, or cardboard. The top band 19 and racket band 16, as well as the bands 20, preferably are made of heavy duty cotton with elastic material contained therewithin. However, elastic synthetics, leather, or plastic may be used. The bottom band 20 also may be of similar construction. The straps 44, 46 and 26 are preferably made of nylon webbing material, but leather, heavy duty elastic, or plastic may also be used. The upper end 14 and projecting flanges 64 and 66 may be integral with the upper end of the holder 12, as shown in FIG. 6, or may be an additional piece of resilient material such as rubber or the like which is slipped upon the upper end of receptacle 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for storing a quantity of tennis balls and dispensing said balls sequentially on demand of a user, the device being adapted to be worn by the user, comprising:

an elongated hollow tube member adapted to be disposed substantially vertically when worn by a user, the tube member containing a plurality of tennis balls, the inner diameter of the tube member being sufficiently larger than the diameter of the balls to allow movement of said balls longitudinally through said tube member;

a tubular projection disposed at the lower end of the elongated hollow tube member, the longitudinal axis of the tubular projection forming an angle of less than 90 degrees with the longitudinal axis of the tube member, the tubular projection having an elliptical opening formed at the distal end thereof, the elliptical opening having a minor axis of a length slightly less than the diameter of each of the balls contained within the tube member, the balls being sequentially displaced into the tubular projection for removal through the elliptical opening on tilting of the lower end of the tube member to downwardly dispose said opening; and, means for releasably attaching the tube member to the body of the user.

2. The structure as set forth in claim 1, wherein the releasably attaching means includes an adjustable shoulder strap member, an adjustable waist belt member, and means interconnecting said belt members for permitting an initial size adjustment for the user of the device and then permitting quick attach-detach of the device from said user without further adjustment.

3. The structure as set forth in claim 2, together with resilient means provided on the other end of the elongated hollow tube member from the tubular projection for permitting use of the device as a tennis ball pick-up structure.

4. The structure as set forth in claim 3, wherein a projecting lip is provided on said other end of the hollow tube member for preventing the adjustable shoulder strap from slipping off said other end of the member.

5. The structure as set forth in claim 4, wherein perforated holes are provided along the hollow tube member for lightening the device as well as for permitting visual reference as to the number of tennis balls contained and stored therewithin.

6. The structure as set forth in claim 5, wherein an elastic member is provided midway of the holder together with a resilient band adjacent the open top of said holder for removably supporting a tennis racket from the device.

7. The structure as set forth in claim 1 wherein the longitudinal axis of the tubular projection forms an angle of approximately 80° with the longitudinal axis of the tube member.

8. The structure as set forth in claim 1 wherein the tubular projection has a thumb-receiving recess formed therein, the outermost portion of the recess communicating with the upper perimetric portion of the elliptical opening, the recess allowing gripping of a tennis ball disposed adjacent the elliptical opening to extract the ball through the opening.

9. The structure as set forth in claim 8 wherein the recess is elongated in the direction of the longitudinal axis of the tubular projection, the longitudinal axis of the recess being essentially parallel to the longitudinal axis of the tubular projection, the lengthwise dimension of the recess being greater than one-half the diameter of one of the balls.

* * * * *